US006939023B2

(12) United States Patent
Ivey

(10) Patent No.: US 6,939,023 B2
(45) Date of Patent: Sep. 6, 2005

(54) LIGHTING APPARATUS AND METHOD

(76) Inventor: Charles Wayne Ivey, 4016 Ardenwoods Dr., Fayetteville, NC (US) 28306

( * ) Notice: Subject to any disclaimer, the term of this patent is extended or adjusted under 35 U.S.C. 154(b) by 148 days.

(21) Appl. No.: 10/120,250

(22) Filed: Apr. 11, 2002

(65) Prior Publication Data

US 2003/0193798 A1 Oct. 16, 2003

(51) Int. Cl.[7] ..... F21V 29/02

(52) U.S. Cl. ..... 362/225; 362/249; 362/218; 362/247

(58) Field of Search ..... 362/216, 218, 362/225, 373, 249, 217, 238, 240, 362, 345, 247, 260, 223

(56) References Cited

U.S. PATENT DOCUMENTS 2,332,138 A * 10/1943 Epstein ..... 40/576
2,564,373 A * 8/1951 Potter ..... 362/223
4,493,013 A * 1/1985 Hawkins ..... 362/307
4,799,134 A * 1/1989 Pinch et al. ..... 362/217
4,849,862 A * 7/1989 Diskin et al. ..... 362/373
5,065,292 A * 11/1991 Aubrey ..... 362/260
5,297,011 A * 3/1994 Triunfol ..... 362/147
5,709,460 A * 1/1998 Lester ..... 362/225

FOREIGN PATENT DOCUMENTS

JP 6-168609 * 6/1994

* cited by examiner

*Primary Examiner*—John Anthony Ward
*Assistant Examiner*—Bao Q. Truong
(74) *Attorney, Agent, or Firm*—Baker & Hostetler LLP

(57) ABSTRACT

A lighting apparatus is provided that includes a bulb housing having a first surface, and a second surface, wherein the first surface is at an angle greater than zero degrees, but less than or equal to forty-five degrees from a second surface, and wherein the second surface is parallel to a plane on which the bulb housing is to be mounted, and a receptacle connected to the first surface. A quad-tube fluorescent bulb is accommodated within the receptacle. When the angle has a value of forty-five degrees, three tubes of the quad-tube fluorescent bulb are exposed and seventy-five percent of the lighting produced by the quad-tube fluorescent bulb is direct light and twenty-five percent of the lighting produced is indirect or reflected light.

23 Claims, 2 Drawing Sheets

LIGHTING APPARATUS AND METHOD

FIELD OF THE INVENTION

The present invention relates generally to a lighting apparatus. More particularly, the present invention is directed to an apparatus and method for maximizing illumination from fluorescent bulbs.

BACKGROUND OF THE INVENTION

Compact fluorescent bulbs utilize less energy than incandescent bulbs designed to produce the same amount of light. Consequently, compact fluorescent bulbs generate less heat in outputting light than comparable incandescent bulbs. As a result, compact fluorescent bulbs are more energy efficient than comparable incandescent bulbs. Compact fluorescent bulbs will also last up to ten times longer than comparable incandescent bulbs.

A quad-tube fluorescent bulb is one example of a compact fluorescent bulb. Quad-tube fluorescent bulbs may be an assembly of four single tubes in a square arrangement, or an assembly of two bent ("U"-shaped) fluorescent tubes arranged in a square-like arrangement.

The positioning of the fluorescent tubes within a light fixture and the shape and/or color of a lampshade or fixture are factors that affect the amount of light output/illumination from the quad-tube fluorescent bulb. Typically, when a quad-tube fluorescent bulb is utilized in a conventional table lamp, the quad-tube fluorescent bulb is installed vertically, i.e., in a position perpendicular to a base of the fixture. When the quad-tube fluorescent bulb is installed vertically, each of the four fluorescent tubes is exposed, such that the maximum amount of illumination is produced from the quad-tube bulb. The maximum amount of illumination consists of seventy-five percent direct light and twenty-five percent reflected light.

There are other lighting devices, such as desk lamps, ceiling light fixtures, ventilator/light combination units, and/or recessed light fixtures where the quad-tube fluorescent bulb extends beyond the housing of the light fixture or does not fit within the light fixture, if the quad-tube fluorescent bulb is installed in a vertical position. As a result, quad-tube fluorescent bulbs are frequently installed in a horizontal position within these fixtures.

In conventional light fixtures that utilize quad-tube fluorescent bulbs, the receptacle for the quad-tube fluorescent bulb is installed so two bulbs are directly in front of the other two bulbs when viewed from directly in front of the fixture. The receptacles for these bulbs only allow the bulb to be installed in this configuration. The maximum amount of illumination in this configuration is fifty percent direct light and fifty percent indirect or reflected lighting.

Accordingly, it is desirable to have a lighting apparatus and method for outputting light from a quad-tube fluorescent bulb that maximizes the amount of direct light output from a quad-tube fluorescent bulb and minimizes the amount of indirect of reflected light output from a quad-tube fluorescent bulb, when the quad-tube fluorescent bulb is installed.

SUMMARY OF THE INVENTION

The foregoing need has been satisfied to a great extent by the present invention wherein, in one aspect of the invention, a lighting apparatus is provided that includes a bulb housing having a first surface, and a second surface, wherein the first surface is at an angle greater than zero degrees, but less than or equal to forty-five degrees from the second surface, and wherein the second surface is parallel to a plane on which the bulb housing is to be mounted, and a receptacle connected to the first surface.

In another aspect of the invention, the lighting apparatus includes a second surface and a third surface and a second receptacle, wherein the second receptacle is positioned on the third surface at an angle greater than zero degrees, but less than or equal to forty-five degrees from the second surface.

In another aspect of the invention, a lighting apparatus is provided that includes a means for accommodating one or more lighting elements, and a means for housing the accommodating means, wherein the accommodating means is mounted on a surface of the housing means, and a means for mounting the housing means, wherein the surface is at an angle greater than zero degrees, but less than or equal to forty-five degrees from the mounting means.

In yet another aspect of the invention, a method for constructing a lighting apparatus is provided that includes tilting a first surface of a bulb housing to an angle greater than zero degrees, but less than or equal to forty-five degrees from a second surface of the bulb housing that is parallel to a plane on which the bulb housing is mounted, and placing a receptacle on the first surface.

Further, in another aspect of the present invention, a lighting apparatus is provided that includes a bulb housing having a base surface, and a receptacle having a first surface, wherein the receptacle is positioned on the base surface such that the first surface is at an angle greater than zero degrees, but less than or equal to forty-five degrees from the base surface.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENTS OF THE INVENTION

Figure 1:
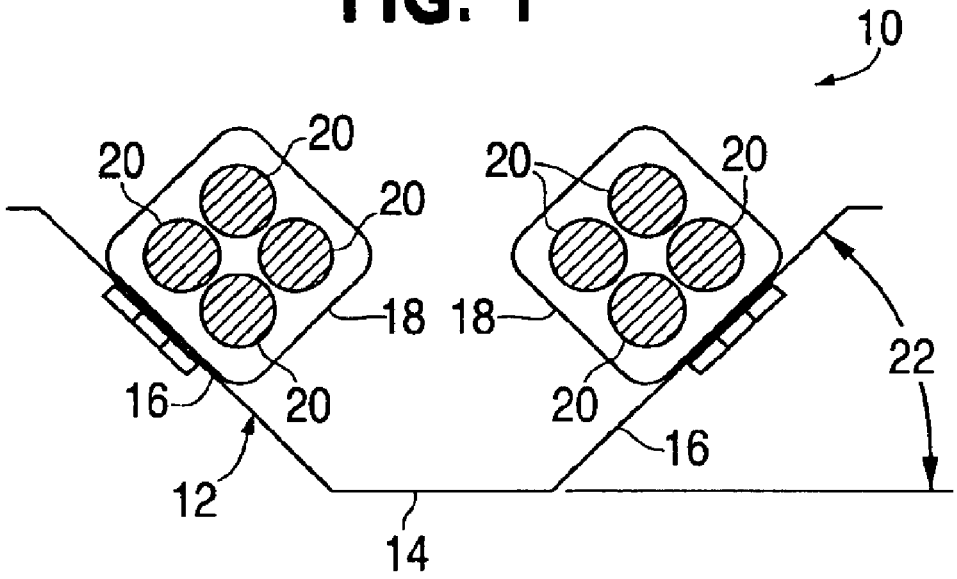
FIG. 1 illustrates a side plan view of a lighting apparatus in accordance with the present invention.

Referring now to the figures wherein like reference numerals indicate like elements, there is shown in FIG. 1 a lighting apparatus 10 in accordance with the present invention. The lighting apparatus 10 includes a bulb housing 12. The bulb housing includes a base surface 14 and two side surfaces 16. Receptacles 18 are coupled to the side surfaces 16 of the bulb housing 12.

Figure 2:
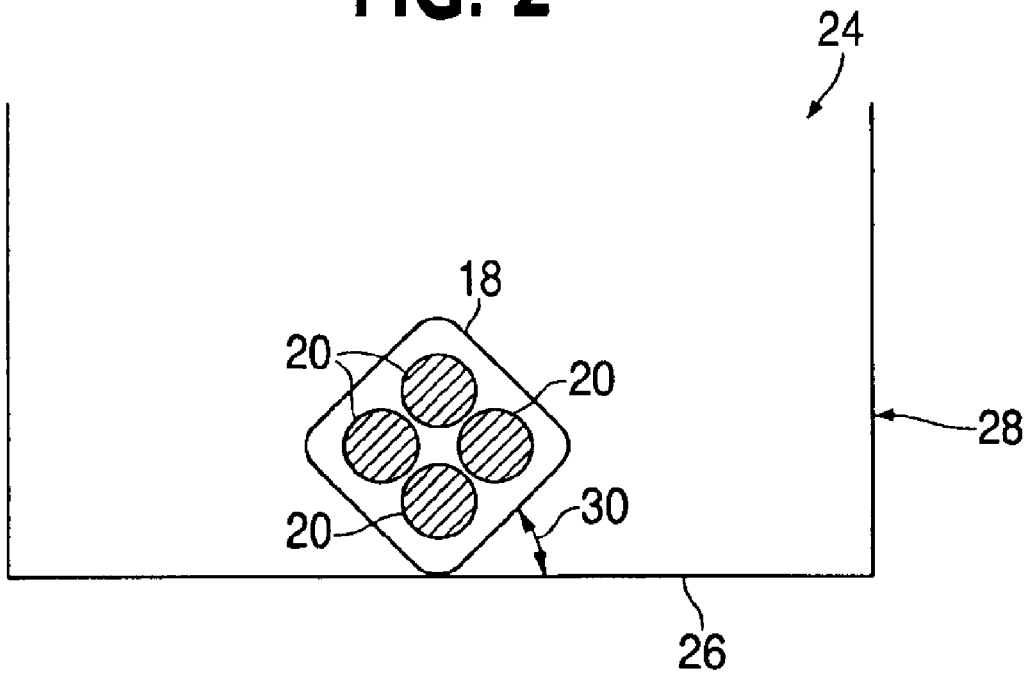
FIG. 2 illustrates a lighting apparatus in accordance with the present invention.

Each receptacle can accommodate, for example, four individual lighting elements, two bent tube lighting elements, or a single lighting element that includes, for example, two bent tube lighting elements or four single lighting elements. Shown in FIG. 2 are four lighting elements 20 and four terminals 21 that are part of a lighting assembly that includes four lighting elements. In an exemplary embodiment of the present invention a quad-tube fluorescent bulb 15 is utilized, for example, model FQ 13E41U/2 by Panasonic, model PLC 13W/41/USA by Phillips, model F13DBX23T4/SPX41 by General Electric and/or model CF13DO0/841 by OSRAM SYLVANIA. It should be understood that the number of surfaces 14, 16 of the bulb housing 12 and the number of receptacles 18 coupled to the housing may vary.

In an exemplary embodiment of the present invention, the receptacles 18 are placed on a side surface 16 that is at an angle 22 having a value that is greater than zero degrees but less than or equal to forty-five degrees from a horizontal surface, such as the base surface 14 of the bulb housing 12.

By placing a surface of the bulb housing 12 an angle 22 that is greater than zero degrees, but less than or equal to forty-five degrees, three of the lighting elements 20 are exposed. Accordingly, the amount of lighting elements 20 exposed is greater than two. Therefore, more than fifty percent of the light output is direct light and less than fifty percent of the light output in indirect or reflected light. Accordingly, the direct light output is increased over the direct light output that would have been generated if there was no inclination of a surface on which the quad-tube fluorescent bulb is coupled and just two of the four bulbs of the quad-tube fluorescent bulb were exposed.

In an exemplary embodiment of the present invention the angle 22 is forty-five degrees. When the angle 22 is forty-five degrees, three of the four tubes are exposed. Accordingly, seventy-five percent of the light output is direct light and only 25 percent is indirect or reflected light.

In an exemplary embodiment of the present invention, as shown in FIG. 1, two quad-tube fluorescent bulbs are each placed on a side surface 16 of the bulb housing 12 that is at an angle of forty-five degrees from the base surface 14 of the bulb housing 12.

Shown in FIG. 2 is another exemplary embodiment of a lighting apparatus 24 of the present invention. As shown in FIG. 2, the receptacle 18 is coupled to a surface, such as the base surface 26 of the bulb housing 28. There is no angle of inclination between the base surface 26 and a horizontal plane. The receptacle 18 is coupled to the base surface 26, such that there is an angle 30 between the surface of the receptacle and the base surface 26 that has a value greater than zero degrees, but less than or equal to forty-five degrees.

In yet another exemplary embodiment of the present invention, rather than the receptacle being fixed to the surface, the receptacle 18 can be placed in a receptacle holder that has a surface at an angle that has a value greater than zero degrees but less than or equal to forty-five degrees from the base surface.

Figure 3:
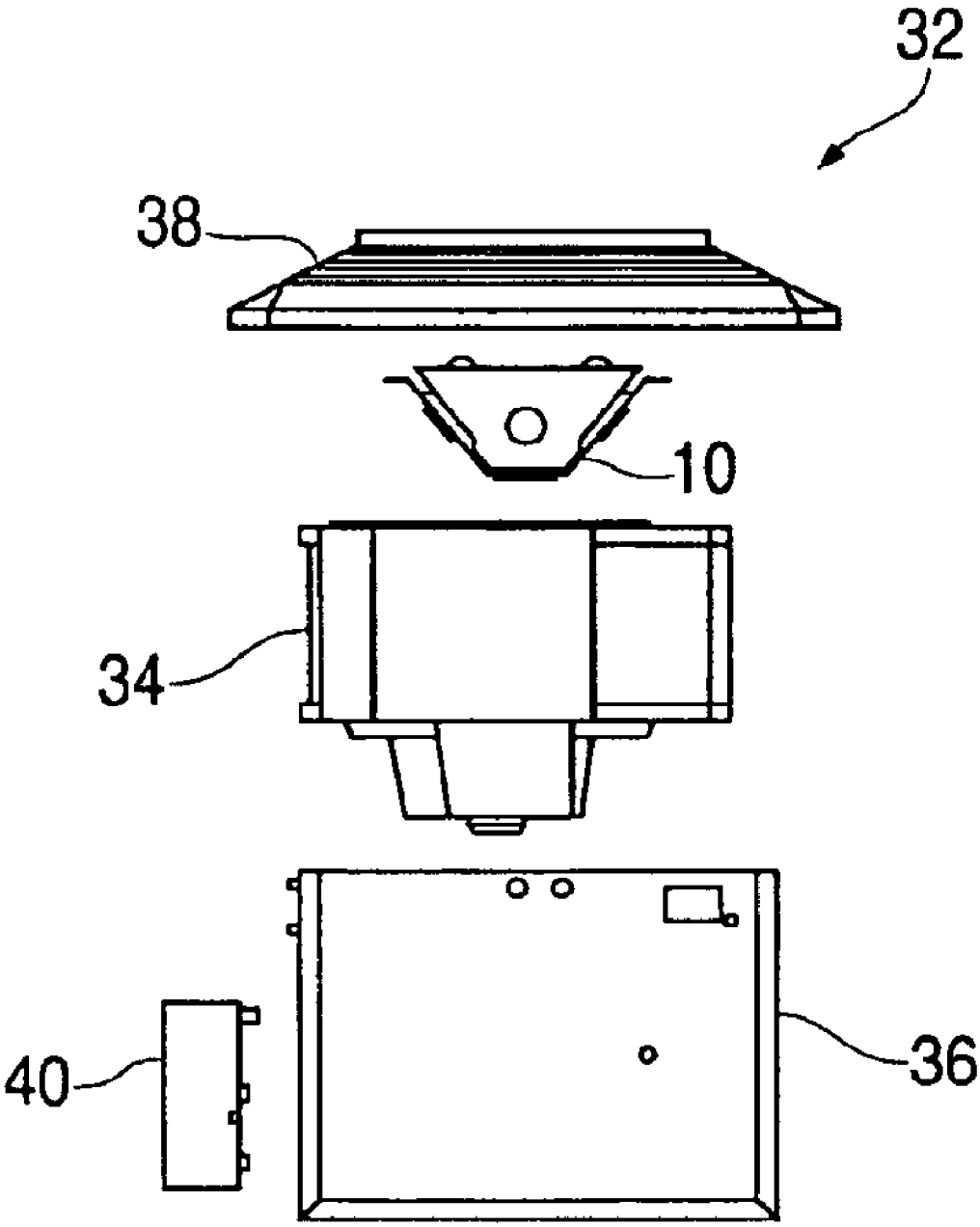
FIG. 3 illustrates an exploded view of a ventilation unit including a lighting apparatus in accordance with the present invention.

In an exemplary embodiment of the present invention the bulb housing 12, 28 is part of a combination ventilator and light and/or nightlight apparatus. For example, a combination ventilator and light apparatus 32 is shown in FIG. 3 that includes the lighting apparatus 10 and a blower 35 accommodated within a blower housing 34. The lighting apparatus 10 is coupled to the blower housing 34 and placed inside of a combination ventilator and light housing 36. In an exemplary embodiment of the present invention, a grille 38 is fitted onto the combination ventilator and light housing 36.

A exhaust adapter 40, such as a duct adapter, may be coupled to the combination ventilator and light housing 36 that provides for the discharge of air from the combination ventilation and light apparatus 32. In an exemplary embodiment of the present invention a back draft damper is integrated with the duct adapter to prevent cold air from entering the combination ventilator and light housing 36.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A lighting apparatus, comprising:

a bulb housing having a first surface and a second surface, wherein said first surface is at an angle greater than zero degrees, but less than forty-five degrees from said second surface, and said second surface is parallel to a plane on which the bulb housing is to be mounted the first surface and the second surface further forming an inside face;

a plurality of bulbs, the plurality of bulbs having a light output; and a first receptacle for accommodating the plurality of bulbs wherein the first receptacle is positioned within the inside face of the bulb housing and mounted on the first surface of the bulb housing such that in operation the light output from the plurality of bulbs is more than fifty-percent direct light.

2. The lighting apparatus of claim 1, further comprising:

a third surface; and a second receptacle, wherein the second receptacle is positioned on the third surface at an angle grater than zero degrees, but less than or equal to forty-five degrees from the second surface.

3. The lighting apparatus of claim 1, wherein the angle has a value of forty-five degrees.

4. The lighting apparatus of claim 1, wherein the first receptacle accommodates quad-tube light bulbs.

5. The lighting apparatus of claim 1, wherein the first receptacle accommodates four single lighting elements.

6. The lighting apparatus of claim 1, wherein the first receptacle accommodates two bent tube lighting elements.

7. The lighting apparatus of claim 4, wherein the quad-tube light bulbs are fluorescent lighting elements.

8. The lighting apparatus of claim 1, further comprising:

a blower; and a blower housing, wherein the bulb housing is coupled to the blower housing.

9. A lighting apparatus, comprising:

means for accommodating a plurality of lighting elements having a light output; and means for housing said accommodating means, said housing means having a first and second surface, the first and second surface further forming an inside face, wherein the accommodating means is positioned within the inside face of the housing means and mounted on the first surface of the housing means such that, in operation, the light output from the plurality of lighting elements is greater than fifty-percent direct light; and wherein the first surface is at an angle with the second surface having a value greater than zero degrees, but less than or equal to forty-five degrees.

10. The lighting apparatus of claim 9, wherein the angle has a value of forty-five degrees.

11. The lighting apparatus of claim 9, wherein the accommodating means is a receptacle.

12. The lighting apparatus of claim 9, wherein the housing means is a bulb housing.

13. The lighting apparatus of claim 9, wherein the plurality of lighting elements are quad-tube light bulbs.

14. The lighting apparatus of claim 13, wherein the quad-tube light bulbs are fluorescent lighting elements.

15. The lighting apparatus of claim 9, wherein the plurality of lighting elements are four single lighting elements.

16. The lighting apparatus of claim 9, wherein the plurality of lighting elements are two bent tube lighting elements.

17. A method for constructing a lighting apparatus, comprising:

providing a bulb housing having a first surface and a second surface;

tilting the first surface of the bulb housing to an angle greater than zero degrees, but less than or equal to forty-five degrees from the second surface of the bulb housing, wherein the second surface is parallel to a plane on which the bulb housing is to be mounted;

forming an inside face from the first surface and the second surface; and placing a receptacle for receiving a plurality of bulbs, the plurality of bulbs having a light output, within the inside face of the bulb housing and mounting the receptacle on the first surface such that, in operation, the light output from the plurality of bulbs is more than fifty-percent direct light.

18. The method of claim 17, further comprising:

accommodating quad-tube light bulbs within the receptacle.

19. A lighting apparatus, comprising:

a bulb housing having a base surface and two side surfaces forming an inside face; and a receptacle for accommodating a plurality of bulbs, the plurality of bulbs having a light output, wherein the receptacle is positioned within the inside face of the bulb housing such that more than fifty-percent of the light output from the plurality of bulbs is direct light and less than fifty-percent of the light output from the plurality of bulbs is reflected light.

20. A lighting apparatus, comprising:

a bulb housing, the bulb housing having a base surface and two side surfaces forming a U-shape with an inside face; and a receptacle for accommodating a plurality of bulbs, the plurality of bulbs having a light output, wherein the receptacle is positioned within the inside face of the bulb housing, such that more than fifty percent of the light output from the plurality of bulbs is direct light and less than fifty percent of the light output from the plurality of bulbs is reflected light.

21. The lighting apparatus of claim 20, wherein the receptacle has four terminals.

22. The lighting apparatus of claim 20, wherein the plurality of bulbs comprise four lighting elements.

23. The lighting apparatus of claim 20, wherein the light output is greater than sixty percent but less than or equal to seventy-five percent direct light.

* * * * *